US007559165B2

(12) United States Patent
Wiegel

(10) Patent No.: US 7,559,165 B2
(45) Date of Patent: Jul. 14, 2009

(54) WEATHER PROTECTION SYSTEM FOR SIGNAGE

(75) Inventor: John Parr Wiegel, Palmyra, NY (US)

(73) Assignee: StormBlok Systems, Inc., Rochester, NY (US)

( * ) Notice: Subject to any disclaimer, the term of this patent is extended or adjusted under 35 U.S.C. 154(b) by 0 days.

(21) Appl. No.: 11/690,710

(22) Filed: Mar. 23, 2007

(65) Prior Publication Data

US 2008/0229638 A1 Sep. 25, 2008

(51) Int. Cl.
*G09F 15/00* (2006.01)
*G09F 15/02* (2006.01)

(52) U.S. Cl. ..... 40/606.03; 40/602; 40/612

(58) Field of Classification Search ..... 40/440, 40/592, 602, 606.03, 612; 52/202, 3, 38, 52/84, DIG. 12; 150/154
See application file for complete search history.

(56) References Cited

U.S. PATENT DOCUMENTS 1,327,427 A * 1/1920 Foster ..... 40/606.03
1,880,835 A * 10/1932 Crickmer ..... 40/440
1,928,366 A * 9/1933 Buckingham ..... 160/81
2,598,940 A 6/1952 Robie
2,608,198 A 8/1952 Goodman
2,798,508 A 7/1957 Kahn
3,021,894 A 2/1962 La Due
3,064,550 A 11/1962 O'Day et al.
3,149,381 A * 9/1964 Santo ..... 49/71
3,484,994 A 12/1969 Ashby
3,691,703 A 9/1972 Barnes
3,760,541 A * 9/1973 Fulcher ..... 52/203
3,777,136 A * 12/1973 Okuda ..... 362/102
3,828,455 A * 8/1974 Bentley ..... 40/602
3,848,367 A 11/1974 Barnes
3,947,985 A * 4/1976 Skrzypczak ..... 40/473
3,949,527 A 4/1976 Double et al.
4,069,853 A * 1/1978 Surabian ..... 135/87
4,144,900 A * 3/1979 Kinski ..... 135/20.1

(Continued)

FOREIGN PATENT DOCUMENTS

DE 3242200 5/1984

(Continued)

OTHER PUBLICATIONS

Wiegel, J. Parr, Protective Flame Resistant Storm Shield for Reducing Wind Damage, Abandoned Patent Application, Apr. 9, 2004; U.S. Appl. No. 10/822,161.

(Continued)

*Primary Examiner*—Paul N Dickson
*Assistant Examiner*—Christopher E Veraa
(74) *Attorney, Agent, or Firm*—Brian B. Shaw, Esq.; Jodi A. Reynolds, Esq.; Harter Secrest & Emery LLP

(57) ABSTRACT

A weather protection system for a sign having a planar surface, the system comprising a frame coupled to the sign, the frame having a plurality of struts, a first end of the frame arranged proximal to the planar surface of the sign and a second end arranged distal to the planar surface of the sign, and a storm protection material coupled to the frame.

6 Claims, 8 Drawing Sheets

U.S. PATENT DOCUMENTS

| | | | | | |
|---|---|---|---|---|---|
| 4,471,586 | A | * | 9/1984 | Shuch et al. | 52/36.2 |
| 4,605,030 | A | | 8/1986 | Johnson | |
| 4,655,236 | A | | 4/1987 | Dorame | |
| 4,726,149 | A | | 2/1988 | Tryba | |
| 4,727,898 | A | | 3/1988 | Guma | |
| 4,837,974 | A | | 6/1989 | Jokel | |
| 4,887,543 | A | * | 12/1989 | Rockhill | 116/201 |
| 4,944,321 | A | | 7/1990 | Moyet-Ortiz | |
| 4,991,363 | A | | 2/1991 | Randmae | |
| 4,998,381 | A | | 3/1991 | Langenhorst | |
| 5,084,994 | A | * | 2/1992 | Elmer | 40/591 |
| 5,158,103 | A | | 10/1992 | Leu | |
| 5,176,421 | A | | 1/1993 | Fasiska | |
| 5,197,239 | A | | 3/1993 | Glynn et al. | |
| 5,201,152 | A | | 4/1993 | Heffner | |
| 5,375,354 | A | * | 12/1994 | Rutledge | 40/591 |
| 5,390,889 | A | * | 2/1995 | Hiscock | 248/488 |
| 5,522,165 | A | | 6/1996 | Molla | |
| 5,579,794 | A | | 12/1996 | Sporta | |
| 5,595,233 | A | * | 1/1997 | Gower | 160/232 |
| 5,685,112 | A | | 11/1997 | Fara | |
| 5,740,826 | A | | 4/1998 | Nevin et al. | |
| 5,746,237 | A | | 5/1998 | Arnic | |
| 5,791,090 | A | | 8/1998 | Gitlin et al. | |
| 5,857,477 | A | | 1/1999 | James | |
| 5,881,499 | A | | 3/1999 | Luzzi | |
| 5,983,573 | A | | 11/1999 | MacKarvich | |
| 6,088,975 | A | | 7/2000 | Wiegel | |
| 6,092,857 | A | | 7/2000 | Rivas | |
| 6,176,050 | B1 | | 1/2001 | Gower | |
| 6,176,056 | B1 | | 1/2001 | MacKarvich | |
| 6,220,263 | B1 | | 4/2001 | Randmae | |
| 6,220,648 | B1 | | 4/2001 | Daniel | |
| 6,276,381 | B1 | | 8/2001 | O'Brien | |
| 6,325,085 | B1 | | 12/2001 | Gower | |
| 6,334,282 | B1 | | 1/2002 | Wood | |
| 6,363,670 | B1 | | 4/2002 | Dewitt | |
| 6,405,862 | B1 | | 6/2002 | Allain et al. | |
| 6,513,858 | B1 | | 2/2003 | Lie et al. | |
| 6,517,141 | B1 | | 2/2003 | Su | |
| 6,615,555 | B2 | | 9/2003 | Madden | |
| 6,631,749 | B1 | | 10/2003 | Zambala | |
| 6,672,643 | B1 | | 1/2004 | Brodskiy et al. | |
| 6,682,123 | B2 | | 1/2004 | Burks et al. | |
| 6,705,664 | B1 | | 3/2004 | Lahutsky | |
| 6,745,522 | B2 | | 6/2004 | Germain | |
| 6,865,852 | B2 | | 3/2005 | Gower | |
| 6,893,074 | B1 | | 5/2005 | Wilson | |
| 6,938,881 | B2 | | 9/2005 | Grapes | |
| 6,964,446 | B2 | | 11/2005 | Porter | |
| 7,036,867 | B1 | | 5/2006 | Yang | |
| 7,131,480 | B2 | | 11/2006 | Briscoe et al. | |
| 7,281,752 | B2 | | 10/2007 | Wiegel et al. | |
| 7,337,582 | B1 | | 3/2008 | Klotz | |
| 7,422,348 | B1 | * | 9/2008 | Yates, II | 362/364 |
| 2002/0157696 | A1 | | 10/2002 | O'Brien | |
| 2004/0107619 | A1 | * | 6/2004 | Perelli et al. | 40/610 |
| 2005/0206188 | A1 | | 9/2005 | Wiegel et al. | |

FOREIGN PATENT DOCUMENTS

| | | |
|---|---|---|
| DE | 3245017 | 6/1984 |
| DE | 3520448 | 12/1986 |
| FR | 2585299 | 1/1987 |
| FR | 2705065 | 11/1994 |
| GB | 2177359 | 1/1987 |
| JP | 401101224 | 4/1989 |

OTHER PUBLICATIONS

Wiegel, J. Parr, Vehicle Protection System and Method of Making Same, Pending Patent Application, Filed Jan. 18, 2008; U.S. Appl. No. 12/016,520.

Wiegel, et al., Weather Protection Barrier for a Frangible Opening of a Building, Pending Patent Application, Filed Mar. 22, 2008, U.S. Appl. No. 12/053,574.

Wiegel, J. Parr, Portable Vehicle and/or Equipment Storm Shield, Pending Patent Application, Filed Oct. 11, 2007; U.S. Appl. No. 11/870,954.

* cited by examiner

WEATHER PROTECTION SYSTEM FOR SIGNAGE

CROSS-REFERENCE TO RELATED APPLICATIONS

None.

STATEMENT REGARDING FEDERALLY SPONSORED RESEARCH OR DEVELOPMENT

None.

REFERENCE TO A "SEQUENCE LISTING"

None.

TECHNICAL FIELD

The present invention relates generally to a protection system for signs and the like, and more particularly to a storm protection material coupled to an aerodynamic frame attachment for a sign, which reduces a wind drag coefficient.

BACKGROUND OF THE INVENTION

Hurricanes have devastating effects on structures, equipment and buildings subjected to its gale forces. The violent winds and heavy rain of just one hurricane can cause billions of dollars of damage while leaving people homeless and crippling the local economy for years to come. Particularly vulnerable to hurricane force winds are low-rise buildings, commercial and non-commercial signage, equipment and the like.

It is especially difficult to protect commercial and non-commercial signs as they are usually quite large and placed at significant heights. Some have attempted to protect signs by nailing sheets of plywood over such structures. Others have attempted to merely drape tarps over the structures. However, the structures remain subject to the same wind loading forces and therefore, often still sustain significant damage. Further, it is time consuming and costly to place plywood boards or tarps over signs that are bulky and difficult to reach. Back-lit signs used by commercial establishments to attract customers are especially difficult to protect because the signs have flat, planar surfaces which are not aerodynamic. The impact of falling and blowing debris and the heavy rains also easily destroys backlit signs. Often, there is not enough time before a storm hits to board-up all structures and therefore, signs are sometimes even neglected and left vulnerable to the hurricane forces.

What is needed, then, is a sign protection system that is fast and easy to attach. The need also exists for a cost-effective system that allows signs to become more impact resistant and aerodynamic to reduce the wind drag coefficient and thus, reduce the total wind loading forces

SUMMARY OF THE INVENTION

In one configuration, the system comprises a frame coupled to the sign, the frame having a plurality of struts, a first end of the frame arranged proximal to the planar surface of the sign and a second end arranged distal to the planar surface of the sign, and a storm protection material coupled to the frame.

The present invention also relates to a method of protecting a sign from extreme weather conditions comprising forming a frame about a portion of a sign, wherein the frame comprises an aerodynamic shape, and coupling a storm protective material to the frame, wherein the frame and storm protective material reduce a wind drag coefficient on the sign and allow the sign to be more impact resistant.

A general object of the invention is to provide a weather protection system for a sign having a planar surface.

Another object of the invention is to provide a method and system for significantly reducing the forces and moment coefficients on signs.

These and other objects, features and advantages of the present invention will become readily apparent to those having ordinary skill in the art upon reading the following detailed description of the invention in view of the several drawing figures.

BRIEF DESCRIPTION OF THE DRAWING FIGURES

DETAILED DESCRIPTION OF THE INVENTION

At the outset, it should be appreciated that like drawing numbers on different drawing views identify identical structural elements of the invention. While the present invention is described with respect to what is presently considered to be the preferred embodiment, it is understood that the invention is not limited to the disclosed embodiment.

Furthermore, it is understood that the invention is not limited to the particular methodology, materials, and modifications described and as such may vary. It is also understood that the terminology used herein is for the purpose of describing particular elements only, and is not intended to limit the scope of the present invention, which is limited only by the appended claims.

Figure 1B:
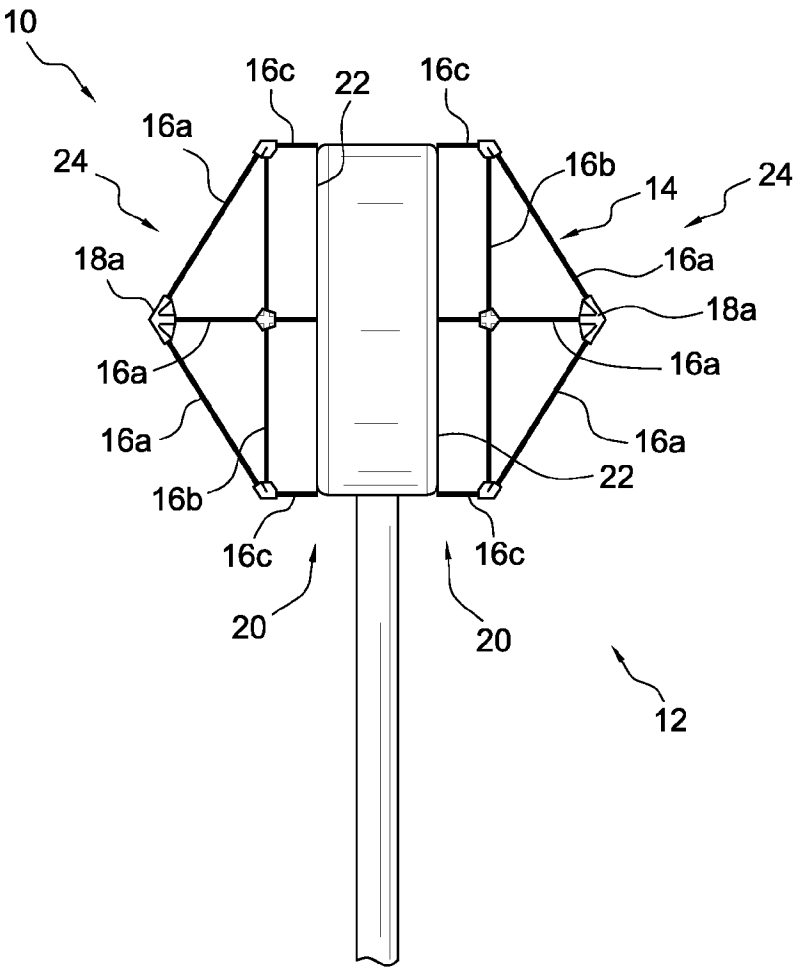
FIG. 1B is a side view of the weather protection system for the sign of the present invention.
Figure 1A:
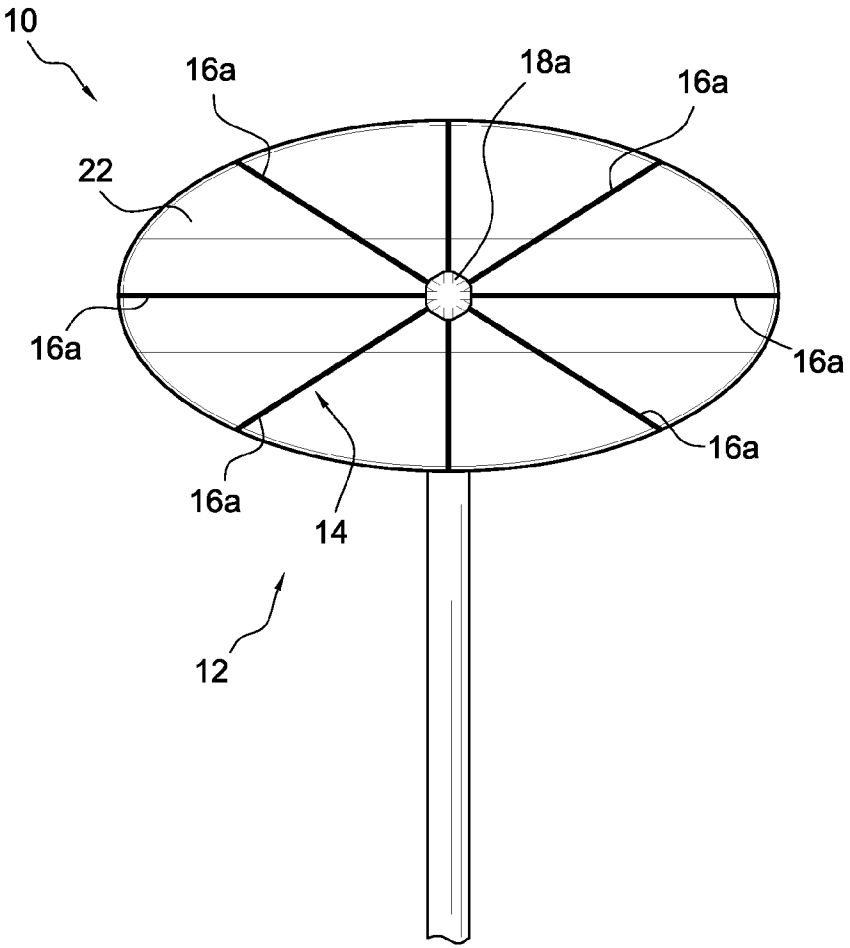
FIG. 1A is a front view of a weather protection system for a sign of a present invention.
Figure 5:
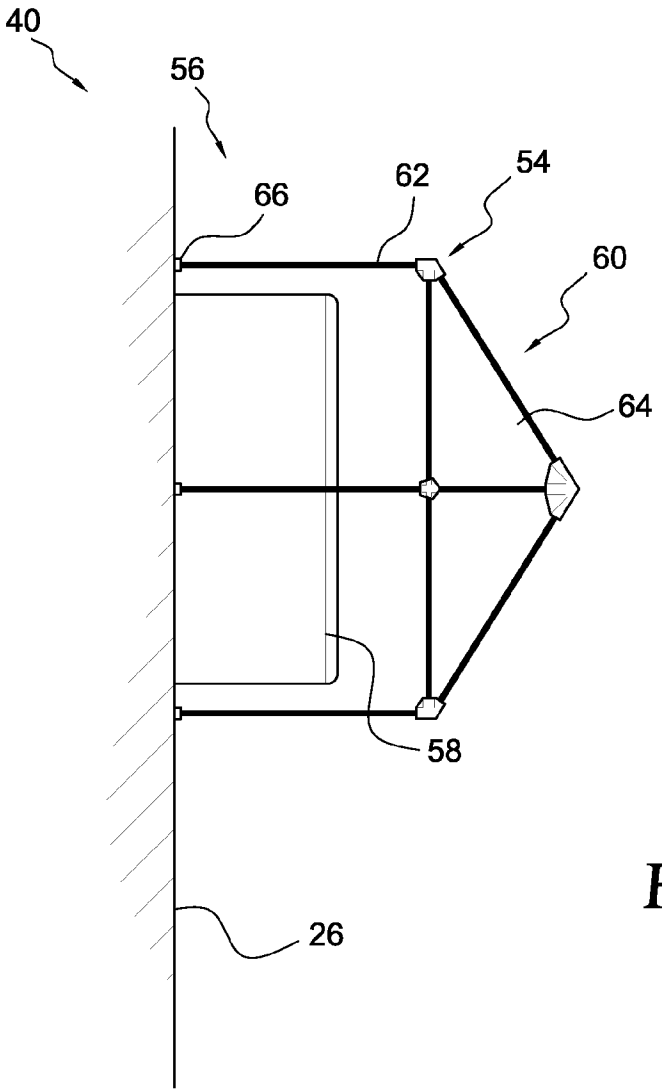
FIG. 5 is a side view of the weather protection system of the present invention for the wall mounted sign.

Referring now to the figures, FIGS. 1A, 1B, 1C and 1D are various views of a weather protection system 10 for a sign 12 of a present invention. Although the sign 12 illustrated in FIGS. 1A, 1B, 1C and 1D is a pole mounted sign, it should be appreciated that other sign types are contemplated. For example, the weather protection system 10 can be used for wall-mounted signs, roof-mounted signs, etc. The weather protection system 10 generally comprises a frame 14 coupled to the sign 12. The frame 14 includes a plurality of struts 16*a*, 16*b* and 16*c* and at least one joint 18*a*. It should be appreciated that the struts 16*a*, 16*b* and 16*c* can be made of any impact resistant material such as metal, fiberglass, stainless steel, aluminum, rubber, plastic, high durometer plastic, etc. The frame 14 includes a first end 20 arranged proximal to a planar surface 22 of the sign 12 and is secured thereto. The first end 20 is connected to a second end 24 arranged distal to the planar surface 22 of the sign 12. It should be appreciated that by "secured" it is meant that the first end 20 may be fixedly secured or releasably secured to the sign 12. Alternatively, the first end 20 may be secured to the wall 26 as shown in FIG. 5 and discussed in more detail infra. If one desires to permanently fixedly secure the frame 14 to the sign 12, it is preferable to construct the frame 14 of clear, high durometer plastic or on the sign 12. As shown in FIG. 1B, it should be appreciated that the sign 12 may have two planar surfaces 22 and therefore, the weather protection system 10 may include two frames 14, one for each planar surface 22.

In one configuration, the first end 20 can be a base portion. As shown in the figures, the first end 20 includes a plurality of struts 16*b* arranged in a rectangular configuration and four extending struts 16*c*. It should be understood that although the first end 20 is shown in a rectangular configuration, other shapes are possible such as oval, circular, square, or other polygonal shapes. At least a portion of the struts 16*a* extend outwardly from the first end 20 and converge at a predetermined distance from the planar surface 22 of the sign 12 to form the second end 24 which can be a protruding portion. The first end 20 is arranged to space the second end 24 away from the planar surface 22 of the sign 12. Depending on the desired configuration, the frame 14 may or may not include the first end 20. Of course, then the second end 24 would be secured to the sign 12 or the wall 26. It should also be understood that the frame 14 can include a centrally positioned threaded pipe (not shown) to allow the second end 24 to be adjusted to a desired length. The frame 14 may also include a light 29 secured at the distal end of the frame 14.

At least the second end 24 is any aerodynamic shape that reduces a wind drag coefficient on the planar surface 22 of the sign 12 when a flexible storm protection material 32 is secured to the frame 14. For example, the second end 24 can be triangular, pyramidal, octagonal pyramidal, cone shaped, triangular prism, etc. In one configuration, the first end 20 defines a curvilinear base portion that circumscribes the perimeter of the sign 12. The second end 24 is cone shaped having struts 16*a* that converge at an apex. It should be understood that the first end 20 may entirely or partially circumscribe the perimeter of the sign 12 and the second end 24 may be substantially cone shaped. The storm protection material 32 may include a centrally positioned aperture for receiving the apex formed by struts 16*a*.

it should be appreciated by those having ordinary skill in the art that the "wind drag coefficient" or $C_d$ is the quantity that describes a characteristic amount of aerodynamic drag caused by wind, which is used in the drag equation:

$$F_d = \tfrac{1}{2} C_d \rho v^2 A$$

The drag force, $F_d$, is proportional to the drag coefficient number, $C_d$. Thus, reducing the drag force coefficient by adding the weather protection system 10 can reduce the drag force. It should be appreciated that other dimensionless force and moment coefficients may be reduced as well. The weather protection system 10 can be configured to reduce at least one of the following force and moment coefficients by at least 20%, preferably by at least 35% and more preferably by at least 50%:

$$C_n = \frac{N}{1/2 \rho v^2 A} \quad \text{(Normal Force Coefficient)}$$

$$C_{ax} = \frac{A_x}{1/2 \rho v^2 A} \quad \text{(Axial Force Coefficient)}$$

$$C_s = \frac{S}{1/2 \rho v^2 A} \quad \text{(Side Force Coefficient)}$$

$$C_{pm} = \frac{M_p}{1/2 \rho v^2 AL} \quad \text{(Pitching Moment Coefficient)}$$

$$C_{rm} = \frac{M_r}{1/2 \rho v^2 AL} \quad \text{(Rolling Moment Coefficient)}$$

$$C_{ym} = \frac{M_y}{1/2 \rho v^2 AL} \quad \text{(Yawing Moment Coefficient)}$$

The flexible storm protection material 32 having at least some tensility is coupled to the frame 14 providing a barrier from hurricane force winds, heavy rains, and windborne debris. In one configuration, the flexible material 32 encapsulates the frame 14 protecting the sign 12. In another configuration, the material 32 encapsulates the frame 14 and the sign 12. In a preferred embodiment, the first end 20 spaces the second end 24 at least four inches from the planar surface 22 of the sign 12. It should be appreciated that having the storm material 32 pulled taut around the frame 14 and spacing the first end 20 of the frame 14 at a distance from the planar surface 22 of the sign 12 allows the weather protection system 10 to be impact resistant. Alternatively, the storm protection material 32 could have an elastic characteristic that allows the material to change shape in response to debris striking the material 32 and then return to its original form when the force is removed. Either the tensile strain or elasticity of the material will reduce the acceleration of windborne debris over a longer period of time and reduce the force of the impact according to Newton's second law of motion (F=ma). Therefore, the force of the debris impact will be reduced because it will have a longer time to decelerate.

Additionally, the storm protection material 32 coupled to the frame 14 can cause windborne debris to deflect off the weather protection system 10 and therefore the debris causes less damage. That is, without the storm protection system 10 on the sign 12, a significant amount of wind and debris will strike the planar surface 22 of the sign 12 "straight-on" meaning at a line perpendicular to the planar surface 22 of the sign 12. The weather protection system 10, however, will cause a significant amount of wind and debris to strike the surface of the system 10 at an "angle of incidence". That is, the wind and debris will be deflected at an angle from the line perpendicular to the planar surface 22 of the sign 12. This angle of incidence is a vector that can be resolved into a horizontal component and a perpendicular component. Having a greater angle of incidence increases the horizontal component magnitude and decreases the perpendicular component magnitude. Decreasing the perpendicular component magnitude will reduce the amount of force the system 10 absorbs when struck by wind and debris and therefore the debris and wind will cause less damage.

Further, the spacing between the first end 20 and the planar surface 22 of the sign 12 allows the impact to be absorbed away from the sign 12 leaving the sign 12 unharmed from hurricane force winds, heavy rain, and debris.

Figure 1C:
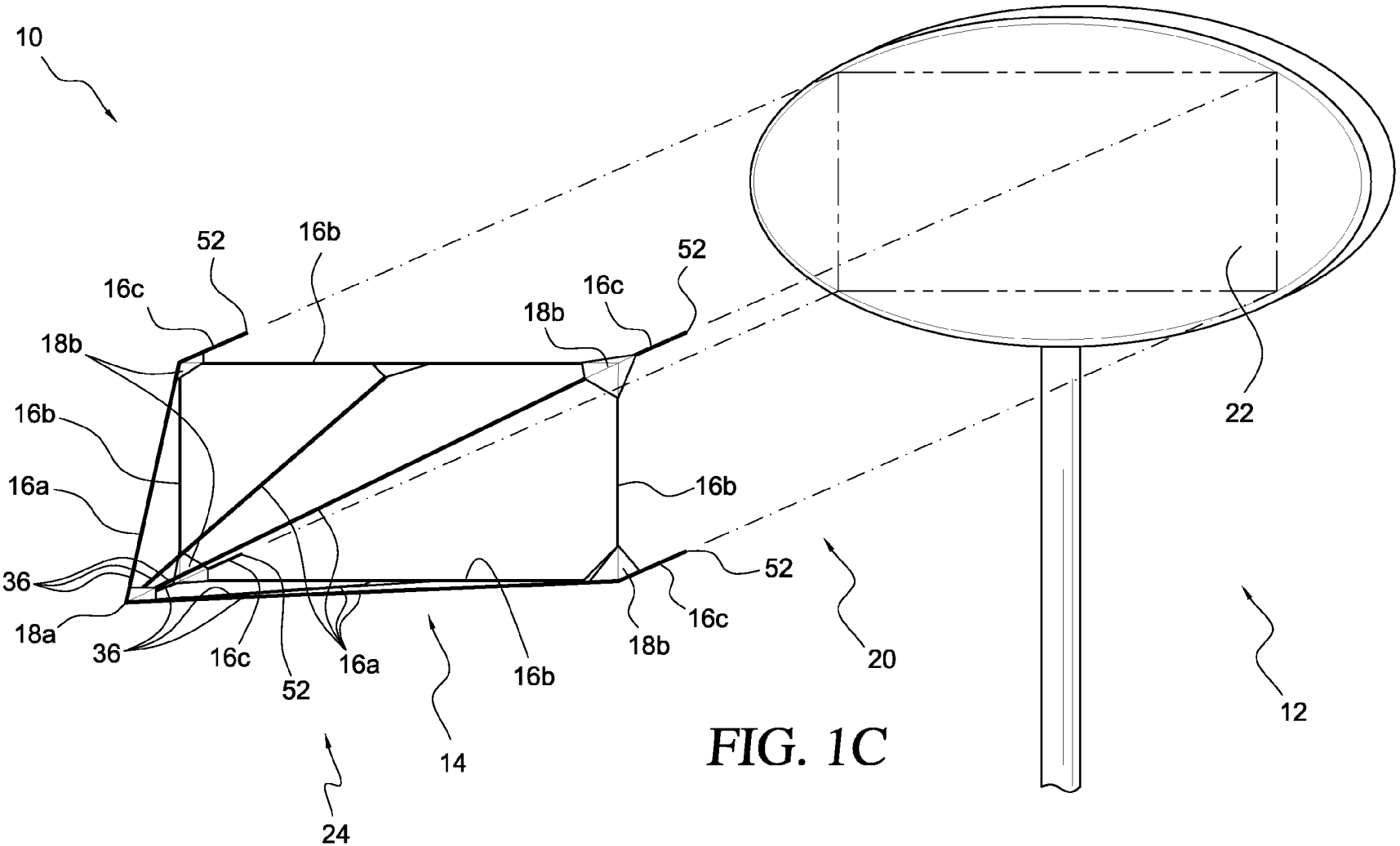
FIG. 1C is an exploded view of the weather protection system for the sign showing a frame of the present invention.
Figure 1D:
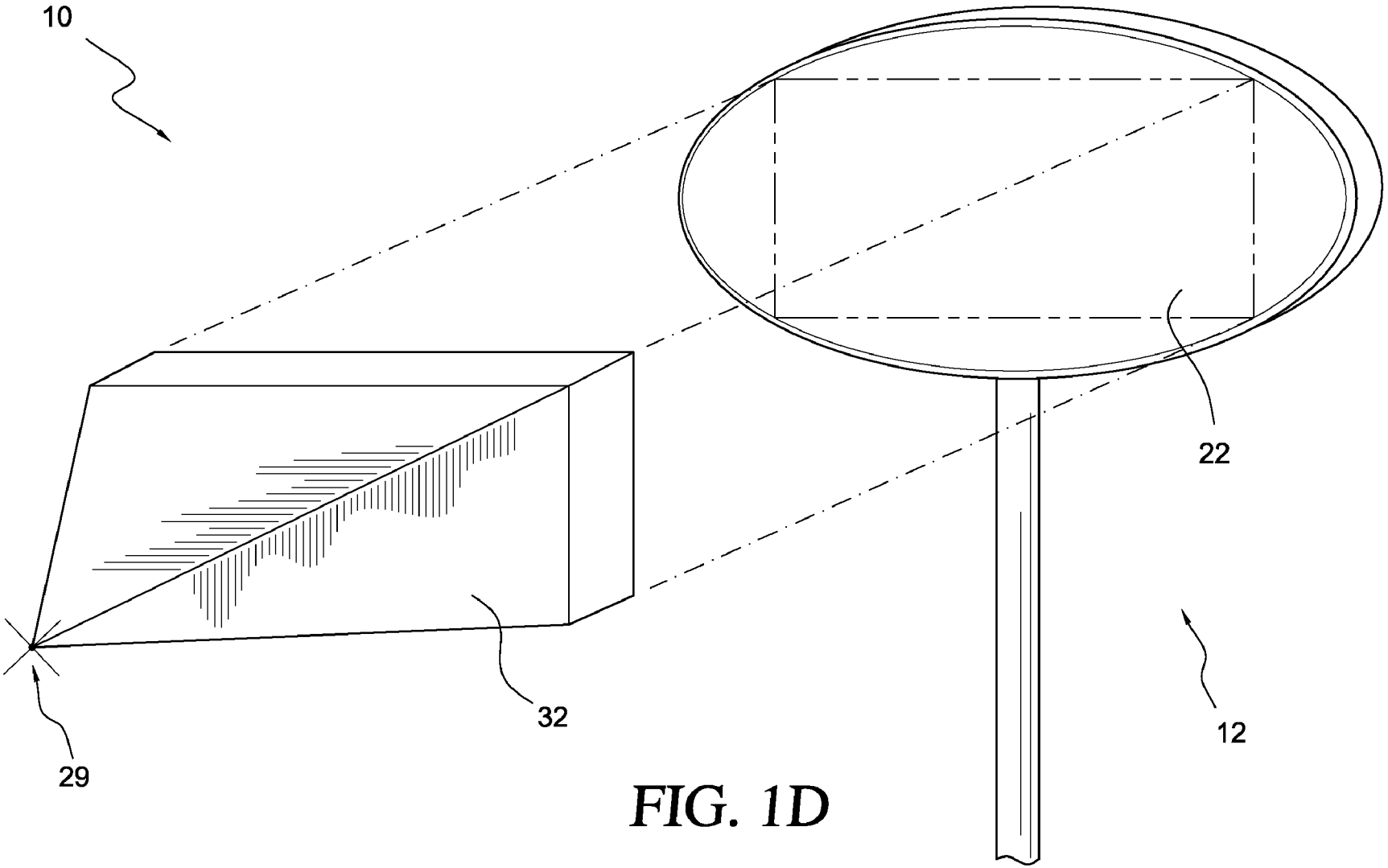
FIG. 1D is an exploded view of the weather protection system for the sign showing a storm protection material encapsulating the frame.
Figure 2B:
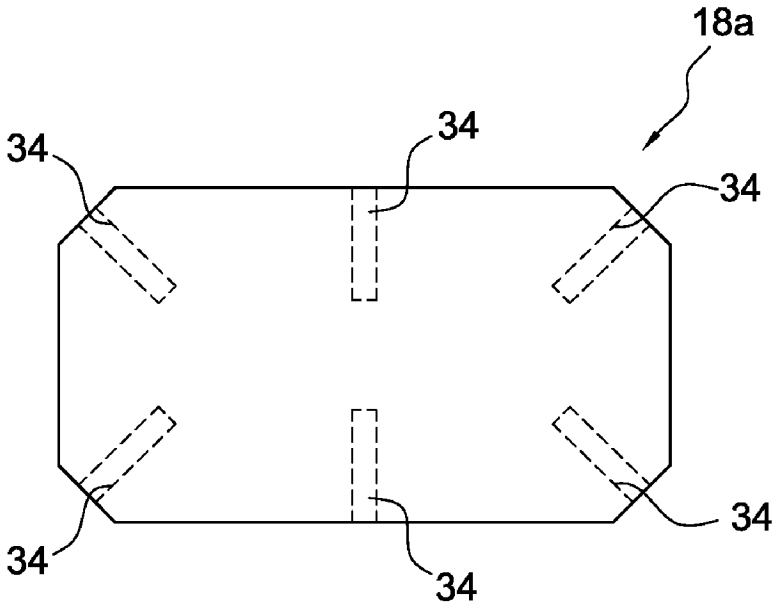
FIG. 2B is a top plan view of the joint for the frame of the present invention.
Figure 2A:
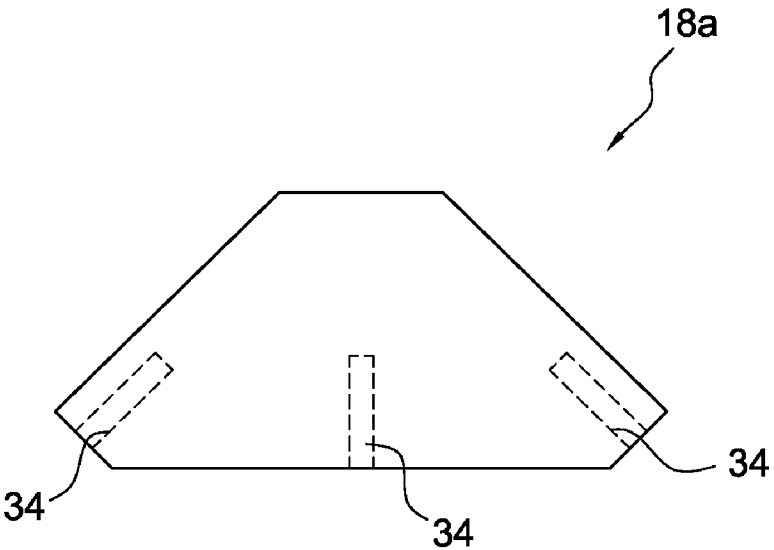
FIG. 2A is a side view of a joint for the frame of the present invention.

FIGS. 2A and 2B are various views of the joint 18*a* for the frame 14 of the present invention. The frame 14 includes at least one joint 18*a* having a plurality of channels 34 and is distally disposed from the planar surface 22 of the sign 12 to connect a plurality of the struts 16*a* together. More specifically, the plurality of channels 34 are sockets that receive the distal ends 36 of the struts 16*a* (shown in FIG. 1C). The channels 34 extend radially outwardly from the joint 18*a* and terminate along the periphery of the joint 18*a*. The joint 18*a* can have any shape that allows the struts 16*a* to be positioned in an aerodynamic shape. For example, depending on the number of struts 16*a* used to make the frame 14, the joint 18*a* can be triangular, pyramidal, octagonal pyramidal, cone shaped, triangular prism, etc. It should be apparent by those having ordinary skill in the art that other means may be used to join the struts 16*a* together in an aerodynamic configuration. For example, any type of hub arranged to receive the struts 16*a* can be used as the joint 18*a*. The joint 18*a* can be made of any impact resistant material, including but not limited to metal, fiberglass, stainless steel, aluminum, rubber, plastic, high durometer plastic, etc. Further, the struts 16*a*, 16*b* and 16*c* can include shock-cords or elastic cords which run through a hollow opening of the struts 16*a*, 16*b* and 16*c* to connect the struts 16*a*, 16*b* and 16*c* together. Once assembled, the frame 14 can be locked into place by a frame lock 38 as described in more detail infra. A plurality of joints 18*b*, each having a multitude of channels 34, can be used to connect the struts 16*a* to the first end 20 having the struts 16*b* and 16*c* as shown in FIG. 1C.

Figure 3:
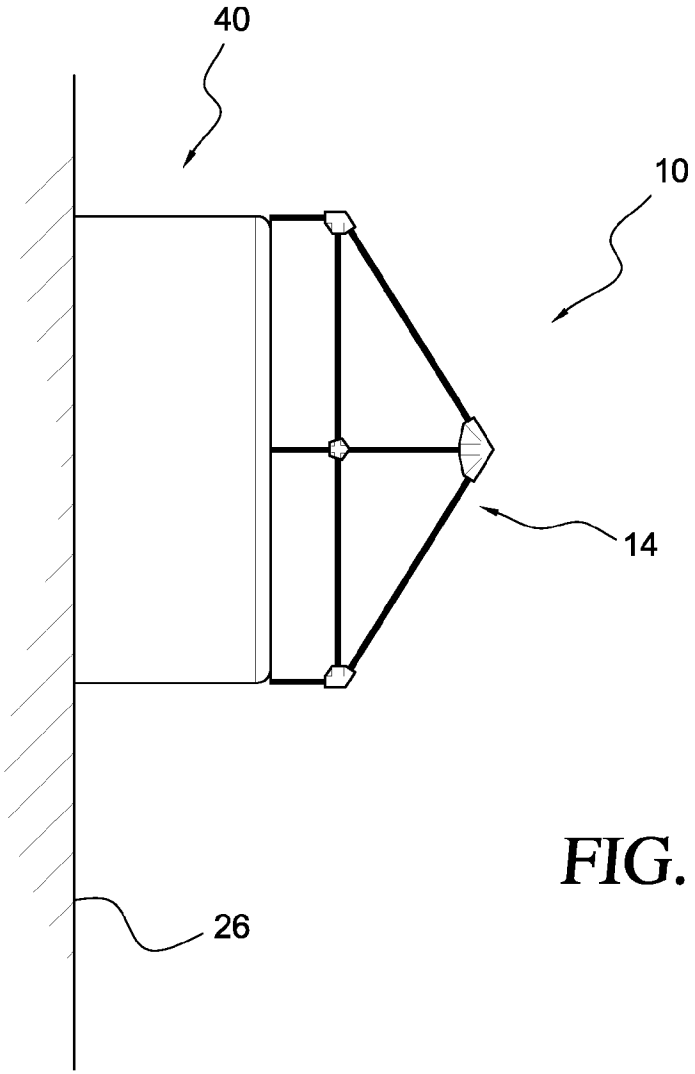
FIG. 3 is a side view of the weather protection system of the present invention for a wall mounted sign.

FIG. 3 is a side view of the weather protection system 10 for a wall mounted sign 40 of the present invention showing the frame 14 secured to the sign 40 as described infra.

Figure 4B:
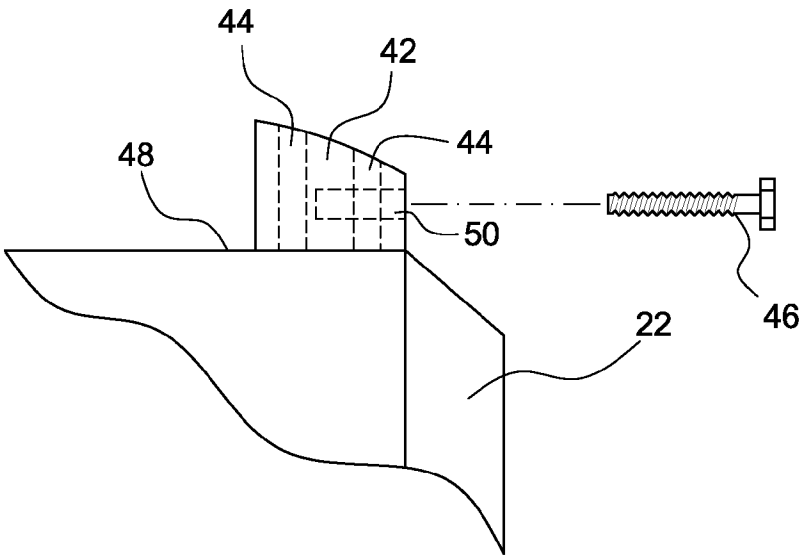
FIG. 4B is a partial side view of the mounting brackets of the sign of the present invention.
Figure 4A:
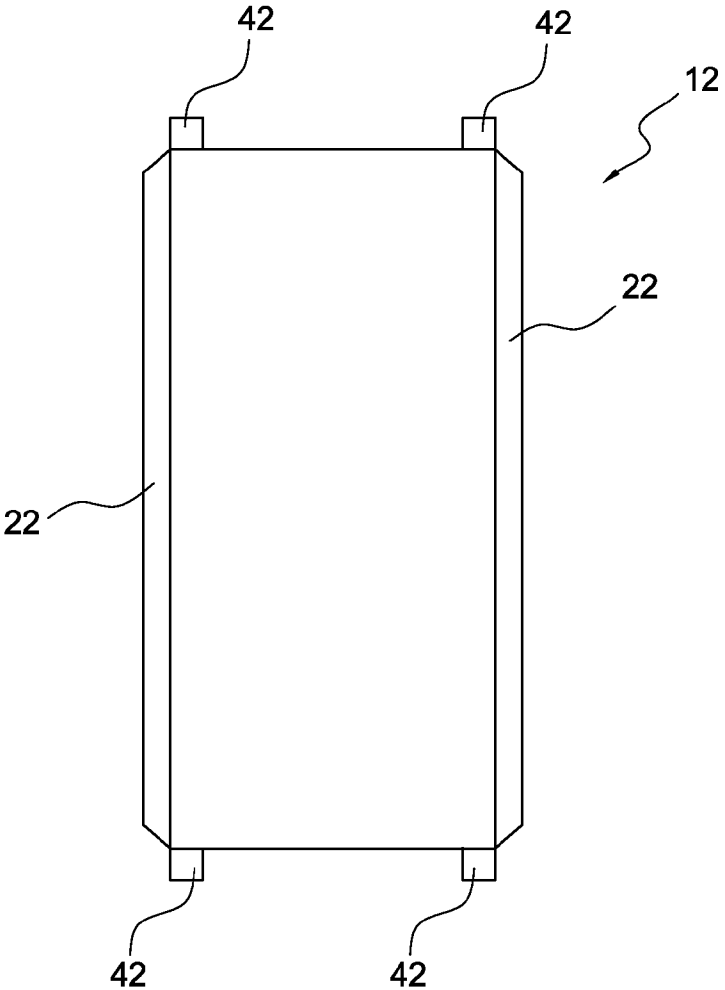
FIG. 4A is a side view of the sign of the present invention having mounting brackets.

FIGS. 4A and 4B are various views of the sign 12 having mounting brackets 42 of the present invention. The mounting brackets 42 are fixedly secured to and disposed along the periphery of the planar surface 22 of the sign 12. Various types of mounting brackets 42 can be used, including but not limited to those made of high durometer plastic, rubber, stainless steel, aluminum, fiberglass, and other plastic materials and metals. Although the brackets 42 are illustrated in FIGS. 4A and 4B, it should be appreciated that other types of anchor systems can be used to secure the frame 14 to the sign 12. For example, the frame 14 may be clamped to the sign 12. It should be understood that this mounting system can also be used for mounting the frame 14 to the wall mounted sign 40.

In one configuration, the mounting brackets 42 include threaded sockets 44 for receiving bolts 46 such that the brackets 42 are bolted to a peripheral side surface 48 of the sign 12. The brackets 42 further comprise at least one channel 50 to receive each distal end 52 of the struts 16*c* (shown in FIG. 1C). It should be appreciated by those having ordinary skill in the art that the number of mounting brackets 42 required to mount the frame 14 corresponds to the number of struts 16*c* used with the frame 14. Thus, if the frame 14 is octagonal pyramidal having eight struts 16*c* then eight mounting brackets 42 are required. Further, it should be appreciated that other means for securing the brackets 42 may be used, for example, bolts, screws, glue, molly bolts, rivets, etc.

FIG. 5 is a side view of the weather protection system 10 for the wall mounted sign 40. In this configuration, a frame 54 is operatively arranged to be secured to a flat surface, for example, the wall 26. The frame 54 comprises a first end 56 arranged proximal to a planar surface 58 of the sign 40 and a second end 60 arranged distal to the planar surface 58 of the sign 40. It should be appreciated that the first end 56 can be a base portion and the second end 60 can be a protruding portion. The first end 56 is secured to the wall 26 via wall mounting brackets 66 as described in more detail infra. It should be understood that the load on the sign 40 is reduced by the addition of the weather protection system 10 because the system 10 itself rather than the sign is carrying considerable load and transferring this load into the wall.

Figure 6B:
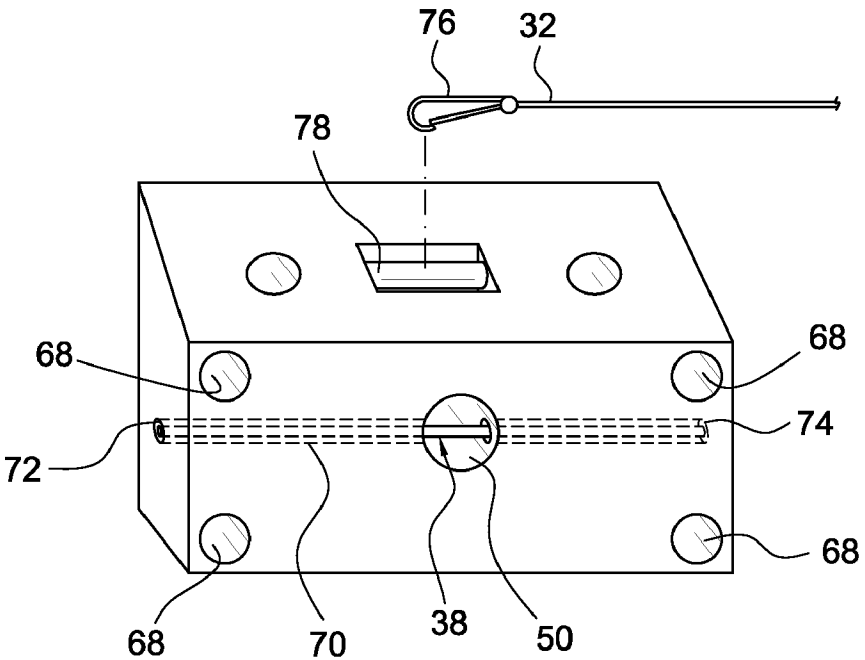
FIG. 6B is a perspective view of the wall mounting bracket of the present invention.
Figure 6A:
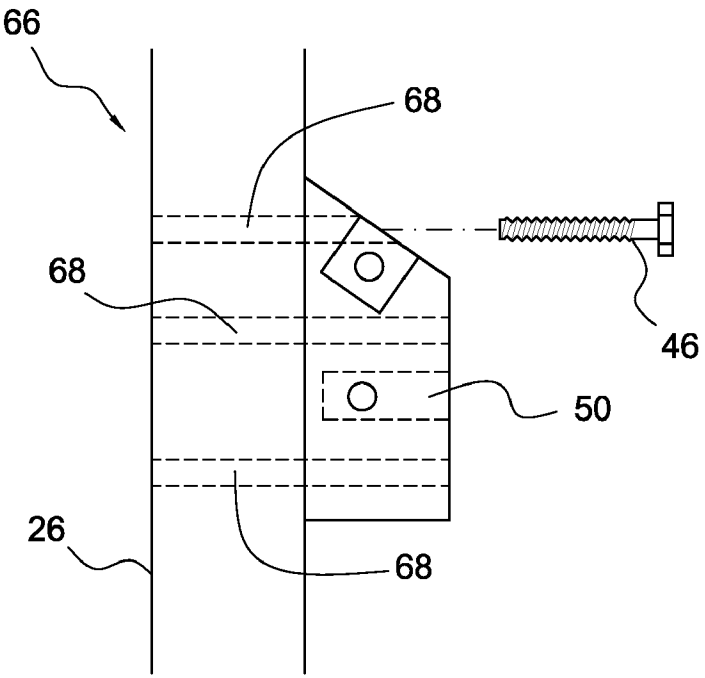
FIG. 6A is a side view of a wall mounting bracket of the present invention.

FIGS. 6A and 6B are various views of the wall mounting bracket 66 of the weather protection system 10 for the wall mounted sign 40. The bracket 66 is mounted to the wall 26 by first drilling bore holes into the surface of the wall 26. Then, at least one threaded socket 68 of the bracket 66 receives at least one bolt 46 to secure the bracket 66 to the wall 26 unless other means are used. In a preferred embodiment a plurality of bolts 46 are used to secure a plurality of brackets 66 to the wall 26. Once the brackets 66 are mounted to the wall 26, the distal ends 52 of the struts 16*c* are secured in the channel 50. Although brackets 66 are illustrated in the figures, it should be appreciated that other types of anchor systems can be used to secure the frame 54 to the wall 26. The frame lock mechanism 38 is then inserted through the distal end 52 of the struts 16*c* to secure the frame 54. In the configuration shown, a passage 70 is operatively arranged to receive the lock mechanism 38 which passes through a first opening 72, then through the distal end 52 of the strut 16*c* and then finally through a second opening 74. It should be apparent that many different types of locking mechanisms can be used including but not limited to cotter pins, drive bolts, push button locking systems and twist-lock mechanisms and these modifications are intended to be within the spirit and scope of the invention as claimed.

The shield material 32 includes a shield clip 76 that is operatively arranged to fasten to a post 78. It should be understood that other fastening means may be used to secure the shield material 32 to the brackets 66 or to the frame 54, including but not limited to ties, buttons, buckles, zippers, etc.

In use, an individual bolts the brackets 42 to the sign 12 or the individual bolts the brackets 66 to the wall 26. Then, the individual forms the aerodynamic shaped frame 14 or 54 about a portion of the sign 12 or 40. The storm protective material 32 is coupled to the frame 14 or 54 by placing the storm protective material 32 over the frame 14 or 54. The frame 14 or 54 and storm protective material 32, therefore, reduce a wind drag coefficient on the sign 12 or 40.

Although the present invention has been described in terms of particular embodiments, it is not limited to these embodiments. Alternative embodiments, configurations or modifications which will be encompassed by the invention can be made by those skilled in the embodiments, configurations, modifications or equivalents may be included in the spirit and scope of the invention, as defined by the appended claims.

The invention claimed is:

1. A weather protection system for a sign having a planar surface, the system comprising:

a frame coupled to the sign, the frame having a plurality of struts, a base portion of the frame arranged proximal to the planar surface of the sign and a protruding portion of the frame arranged distal to the planar surface of the sign, wherein the base portion of the frame substantially circumscribes the sign; and a storm protection material encapsulating the frame.

2. A weather protection system for a sign having a planar surface, the system comprising:

a frame coupled to the sign, the frame having a plurality of struts, a base portion of the frame arranged proximal to the planar surface of the sign and a protruding portion of the frame arranged distal to the planar surface of the sign, wherein the base portion of the frame substantially circumscribes the sign; and a storm protection material encapsulating the frame and the sign.

3. A weather protection system for a sign having at least one planar surface comprising:

a frame removeably connected to the sign, the frame having a plurality of struts and joints, and a base portion, wherein at least part of the plurality of struts extend outwardly and converge at a distance from the at least one planar surface of the sign, and wherein the base portion of the frame substantially circumscribes the sign; and a storm protection material arranged to encapsulate the frame, the storm protection material further comprising means for fastening the storm protection material to the frame, wherein the storm protection material encapsulates the frame and is operatively arranged to reduce a wind drag coefficient.

4. The weather protection system for the sign of claim 3 wherein the at least part of the plurality of struts extend outwardly and converge at a predetermined distance from the at least one planar surface of the sign.

5. A method of protecting a sign from extreme weather conditions comprising:

circumscribing a periphery of the sign with a base portion of a frame, wherein the frame comprises an aerodynamic shape; and coupling a storm protective material to the frame, wherein the storm protective material encapsulates the frame, and wherein the frame and the storm protection material reduce a wind drag coefficient on the sign.

6. A method of protecting a sign from extreme weather conditions comprising:

circumscribing a periphery of the sign with a base portion of a frame, wherein the frame comprises an aerodynamic shape; and coupling a storm protective material to the frame, wherein the storm protective material encapsulates the frame and the sign, and wherein the frame and the storm protection material reduce a wind drag coefficient on the sign.

* * * * *